US005103620A

United States Patent [19]

Lörsch

[11] Patent Number: 5,103,620

[45] Date of Patent: Apr. 14, 1992

[54] METHOD OF FITTING SUCCESSIVELY SUPPLIED FLAT ARTICLES INTO POCKETS AND APPARATUS FOR CARRYING OUT THE METHOD

[76] Inventor: Johannes Lörsch, An der Bleiche 49, D-4172 Straelen 1, Fed. Rep. of Germany

[21] Appl. No.: 711,195

[22] Filed: Jun. 6, 1991

[30] Foreign Application Priority Data

Jun. 19, 1990 [DE] Fed. Rep. of Germany ..... 4019531

[51] Int. Cl.[5] ..... B65B 5/00; B65B 43/39

[52] U.S. Cl. ..... 53/473; 53/258; 53/284.2

[58] Field of Search ..... 53/284.2, 258, 255, 53/251, 250, 249, 247, 467, 473; 493/905, 919, 944, 952, 925, 374

[56] References Cited

U.S. PATENT DOCUMENTS

| | | | |
|---|---|---|---|
| 2,889,066 | 6/1959 | Alberty | 493/944 X |
| 3,025,210 | 3/1962 | Middents et al. | 493/944 X |
| 4,586,321 | 5/1986 | Costa | 53/284.2 X |

FOREIGN PATENT DOCUMENTS

| | | | |
|---|---|---|---|
| 3030545 | 3/1982 | Fed. Rep. of Germany | 493/944 |

*Primary Examiner*—James F. Coan
*Attorney, Agent, or Firm*—Mason, Kolehmainen, Rathburn & Wyss

[57] ABSTRACT

In a method of fitting successively supplied flat articles such as slide frames into insertion pockets in a receiving case, the pockets are arranged in the receiving case in pluralities in juxtaposed relationship and in succession in rows and are accessible from one side of the receiving case. The upper edge of the pockets is formed by a bar portion which extends over a plurality of pockets in a row and can be pivoted upwardly relative to the side walls of the pockets. The articles are fed in groups to the article-insertion location from a feed direction which is transverse with respect to the direction of transportation movement of the receiving case, with the number of articles supplied in a group in that way corresponding at a maximum to the number of insertion pockets for receiving same. An edge part of the bar portion is first lifted and held in the lifted position and the articles in the group are then pushed under the bar portion which they fully lift up, and into the respective pockets. The insertion movement is continued after the article-insertion operation to produce a further transportation movement of the receiving case so that the next cycle can begin. An apparatus for carrying out the method is also disclosed.

12 Claims, 3 Drawing Sheets

METHOD OF FITTING SUCCESSIVELY SUPPLIED FLAT ARTICLES INTO POCKETS AND APPARATUS FOR CARRYING OUT THE METHOD

BACKGROUND OF THE INVENTION

Modern industrial processes often involve situations in which articles are required to be introduced into openings adapted to receive them, for example for despatch of the articles in a suitably protected form or for storage of the articles. Thus for example, there is often a need for flat articles in the form of photographic slides or transparencies, more especially framed slides or transparencies, to be introduced into suitable insertion pockets to be accommodated therein. The photographic slides or transparencies which are framed in an automatically operating framing machine are accordingly to be introduced into dispatch boxes in which they can be sent to the appropriate recipient. Boxes of that kind suffer from a number of disadvantages, for example they are likely to suffer from breakage, rather too readily. In addition, problems may occur in regard to the dispatching and transmission of such boxes through the mail, as the openings of mail boxes and the like, at the recipient end, are often smaller than the dimensions of the boxes. The endeavour is therefore to provide that flat articles for example in the form of slide or transparency frames are introduced into suitable insertion pockets in what are referred to as receiving cases. Cases of that kind are flat flexible cases, preferably comprising plastic foil, which have pockets arranged in pluralities in juxtaposed relationship and in succession in rows. The flat articles in the form of slide frames can thus be inserted into the respective pockets for receiving same, and the case can then be readily dispatched through the mail.

In one method of fitting slide frames into insertion pockets in a receiving case, the insertion pockets are accessible from one side and in the region of their opening have a bar portion which extends over a plurality of insertion pockets in a row and which can be pivoted upwardly relative to the lateral walls of the respective pockets. In order to insert the flat articles or slide frames into the pockets, the bar portion must be lifted up or expanded somewhat in an upward direction, transversely with respect to the general plane of the respective pocket. The bar portion may be opened above each pocket by means of an expansion member or the like in order to permit the articles such as slide frames to be automatically fitted into the respective pockets. However, because of the high operating speed required and also because of the unpredictable behaviour of the bar portion which, by virtue of its flexibility, sometimes curves upwardly and sometimes downwardly, such procedures have not hitherto been entirely successful.

BACKGROUND OF THE INVENTION

An object of the present invention is to provide a method of fitting successively supplied flat articles into insertion pockets in a receiving case, which operates in a secure and reliable fashion and in an automatic procedure.

Another object of the present invention is to provide a method of introducing slides into insertion pockets in a receiving case, which permits a plurality of such articles to be introduced into their respective pockets in a simultaneous procedure.

Still another object of the present invention is to provide a method of fitting slide frames into insertion pockets in a receiving case, which affords enhanced adaptability in terms of the number of slide frames which can be inserted in an operating phase of the method.

Yet a further object of the invention is to provide an apparatus for carrying out the method of fitting successively supplied flat articles into insertion pockets for receiving same.

In accordance with the invention, in respect of the method, the foregoing and other objects are attained by a method of fitting successively supplied flat articles such as photographic slide or transparency frames into insertion pockets in a receiving case, which are arranged in pluralities in juxtaposed relationship and one behind the other in rows, wherein the receiving case is fed to the article-insertion location, for example from a supply roll or the like. The upper boundaries of the insertion pockets which are accessible from one side of the receiving case are each in the form of a bar portion which extends over a plurality of pockets in a row and which can be pivoted upwardly relative to the side boundaries of the pockets. The flat articles are fed to the article-insertion location in a group-wise manner from a feed device disposed transversely with respect to the direction of transportation movement of the receiving case, the number of articles corresponding at a maximum to the number of insertion pockets in the respective row, with the receiving case being in such a position that the bar portion is disposed in the region of the path of movement of the flat articles. The openings of the insertion pockets are directed rearwardly in the direction of the transportation movement of the receiving case and thus face towards the front or leading edges of the articles as they are fed towards the receiving case, said edges being disposed transversely with respect to the article-feed direction. The receiving case is fed to the article-insertion location from a direction which is disposed transversely or inclinedly relative to the plane in which the group of articles is fed thereto, and is then deflected or changed in its direction of movement in such a way that the insertion pockets are then disposed in the plane in which the articles are being fed. Before the first article of a respective group reaches the edge of the bar portion which is towards the article-feed side, the edge of the bar portion is lifted and held in a lifted position such that in a subsequent feed movement of the articles towards the insertion location they pass beneath the lifted edge of the bar portion and thus the bar portion is raised by the articles passing therebeneath. The articles which thus move beneath the bar portion are fed to the respective insertion pockets at spacings such that the articles are each aligned with the respectively associated insertion pocket and the articles are then pushed into the respective insertion pockets with an insertion movement which is transverse with respect to the article-feed direction. After the articles have been thus pushed into the respective insertion pockets, the receiving case performs a further feed movement over a distance corresponding to a row of insertion pockets.

As will be seen in greater detail hereinafter, the method of the invention affords the particular advantage that the step of supplying the articles to the article-insertion location and the actual insertion operation takes place in one plane so that there is no need for the articles firstly to be put into an inclined position, for the purposes of the leading edges thereof to be inserted into the pockets, and then, prior to the actual insertion movement, moved back again into a plane which is in the direction of the plane in which the actual insertion movement takes place. The method of the invention has the further advantage that there is no need to lift the bar portion above each insertion pocket, but rather it is only necessary to lift the edge or a corner of the bar portion, being the edge or corner which is towards the direction from which the articles are fed to the insertion location. By virtue of the edge or corner of the bar portion being lifted and held up, the first article in a group to be inserted can be pushed beneath the lifted corner or edge, so that then the article beneath the bar portion will further lift the bar portion in a region thereof in which it had not been previously lifted by virtue of a lifting movement of its edge or corner. Therefore, once the edge or corner of the bar portion which is towards the article-feed side has been lifted, the bar portion will continue to be automatically lifted by the feed of the group of flat articles thereto. The edge of the bar portion can be readily lifted by virtue of the receiving case being fed to the article-insertion location from a direction which is transverse or inclined relative to the plane in which the group of articles is fed to the article-insertion location, and then changed in its direction in such a way that the insertion pockets are disposed in the article-feed plane. It will be appreciated that in that way, at the location at which the receiving case changes in direction, the bar portion will project somewhat, as a result of the elasticity of its material, so that the edge of the bar portion can be easily lifted and held up.

A still further advantage of the method according to the invention is that there is no need of a separate drive device for producing the forward feed movement of the receiving case after flat articles have been inserted into pockets thereof, as that feed movement can be produced as a direct consequence of the movement for insertion of the articles into the insertion pockets. A still further advantage of the method of the invention is that its operating procedure is such that the apparatus for carrying it out can be converted to deal with different numbers of insertion pockets in a row in the receiving case, without involving a great deal of trouble and expenditure.

If the number of articles supplied is smaller than the number of insertion pockets in a row in the receiving case, a preferred configuration of the method of the invention provides that the supplied articles are symmetrically distributed to the insertion pockets. That prevents the receiving case from being tilted or distorted in the feed movement thereof, which is produced by virtue of the article-insertion movement.

A further form of the method according to the invention may provide that the edge of the bar portion is mechanically lifted and held in its lifted position. Alternatively however it may be provided that the edge of the bar portion is lifted by a suction action, and thus held up.

In accordance with a further aspect of the invention, in respect of apparatus for carrying out the method of the invention, the foregoing and other objects are achieved in that the apparatus includes a stationarily disposed holding projection and a mechanical lifting means for lifting and holding the edge of the bar portion, which is towards the article-feed side. The mechanical lifting means is operable to move the edge of the bar portion from a first position in which it is disposed beneath the stationarily disposed holding projection into a second position in which it is above the holding projection, something which is possible by virtue of the elasticity of the material of the bar portion.

Alternatively, the apparatus may comprise a pneumatic means as the lifting and holding means.

A preferred embodiment of the apparatus according to the invention may include a transportation means for feeding a group of flat articles to the insertion location, the transportation means comprising spacing limb portion, the width of which corresponds to the spacing between the insertion pockets of the receiving case.

In accordance with a further preferred feature of the invention, hold-down limb portions for the receiving case may be disposed above the insertion location. The hold-down limb portions are preferably so arranged that they are each disposed above the lateral boundaries or sides of the insertion pockets, or in the insertion position are aligned with the spacer limb portions of the above-mentioned transportation means. The hold-down limb portions advantageously prevent uncontrolled movement of the receiving case and provide a lateral guidance effect for the flat articles during the insertion movement thereof.

Further objects, features and advantages of the present invention will be apparent from the following description of a preferred embodiment.

DESCRIPTION OF THE PREFERRED EMBODIMENT

Figure 1:
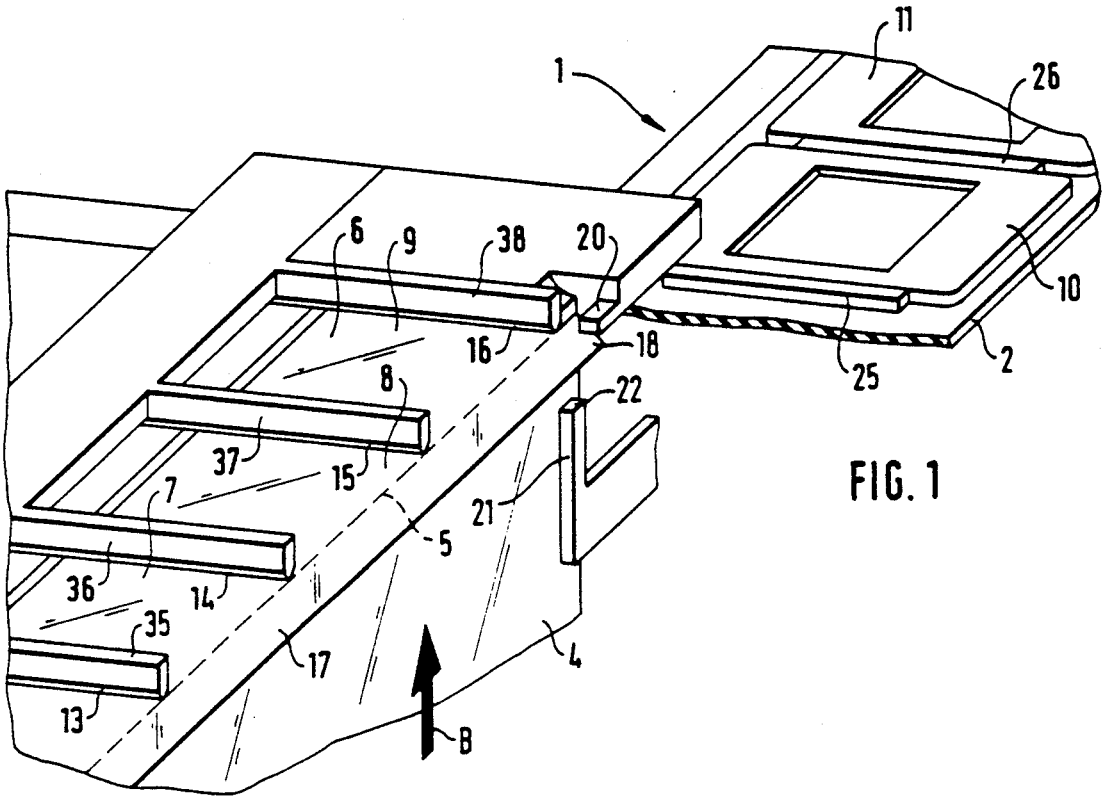
FIG. 1 is a diagrammatic perspective view of part of an apparatus for carrying out the method according to the invention, showing a bar portion of a receiving case in a non-lifted position.
Figure 2:
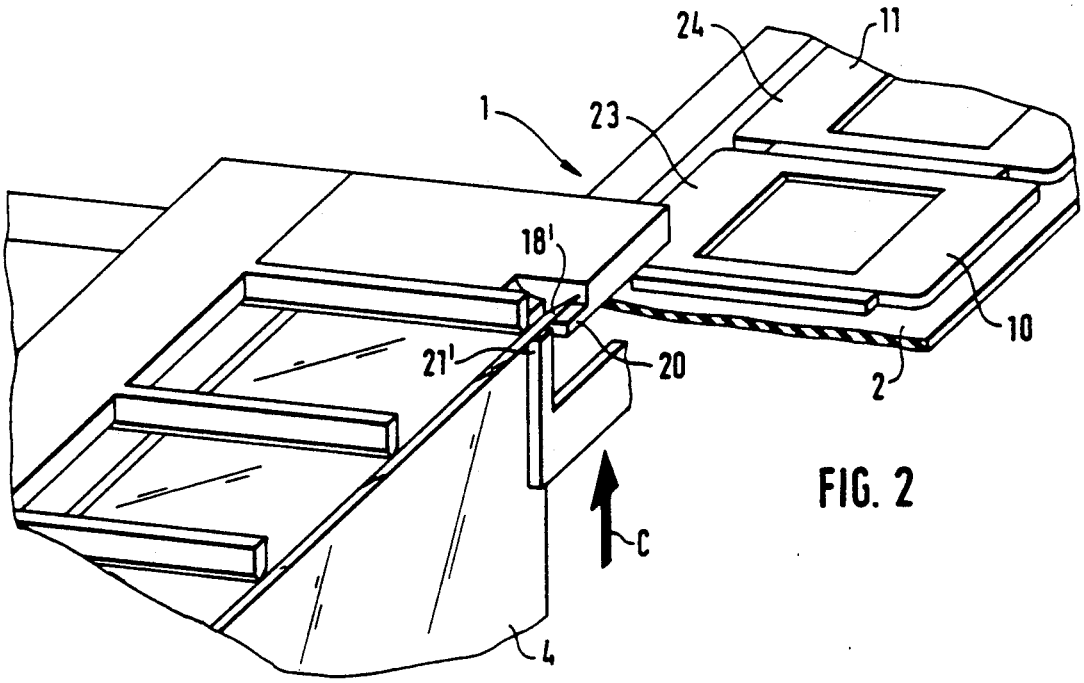
FIG. 2 is a view corresponding to that shown in FIG. 1 but during the lifting movement of the corner or edge of the bar portion.
Figure 3:
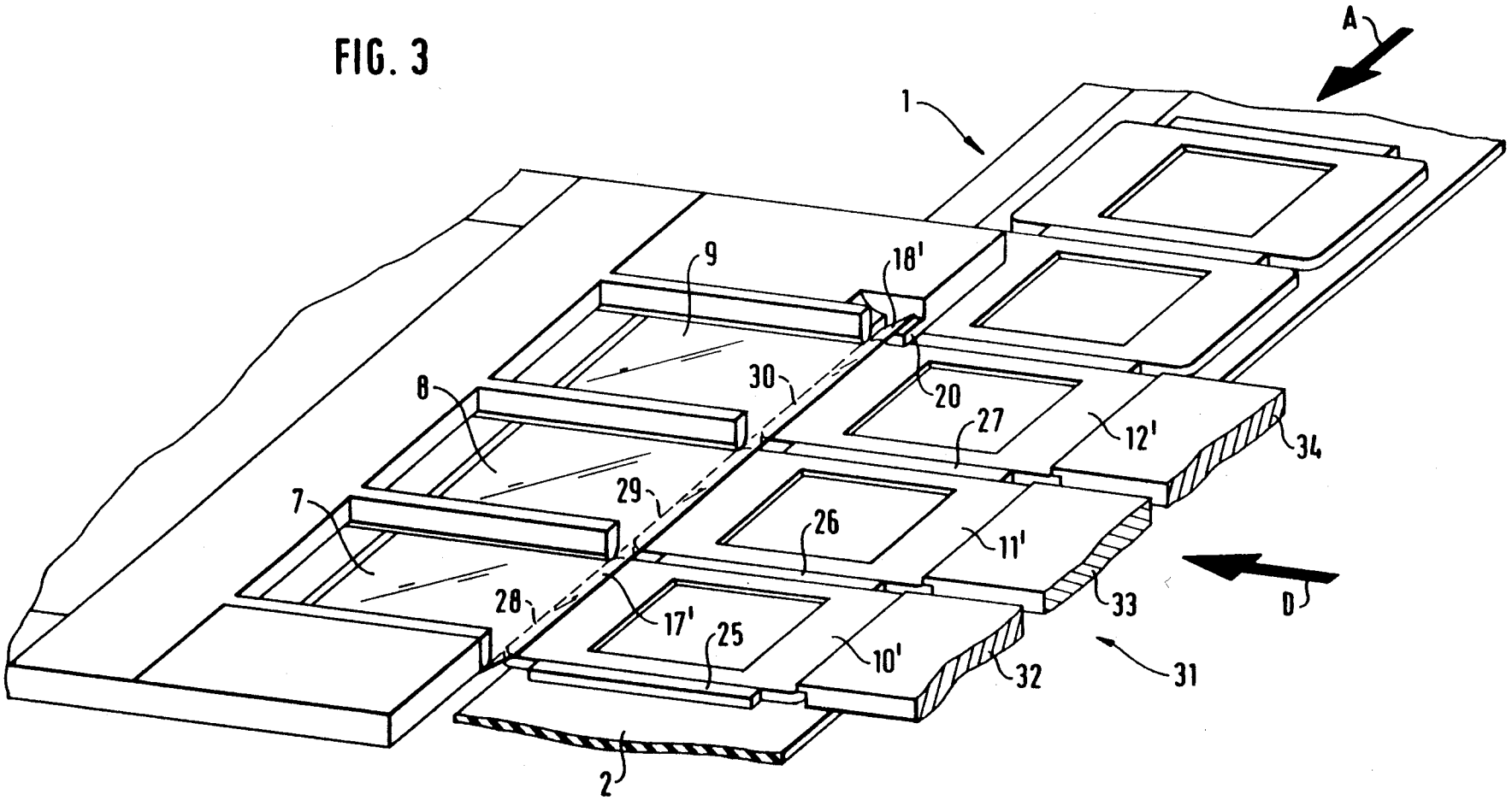
FIG. 3 is a view of a position in which slide frames are being transported into the position for insertion into a respective pocket.
Figure 4:
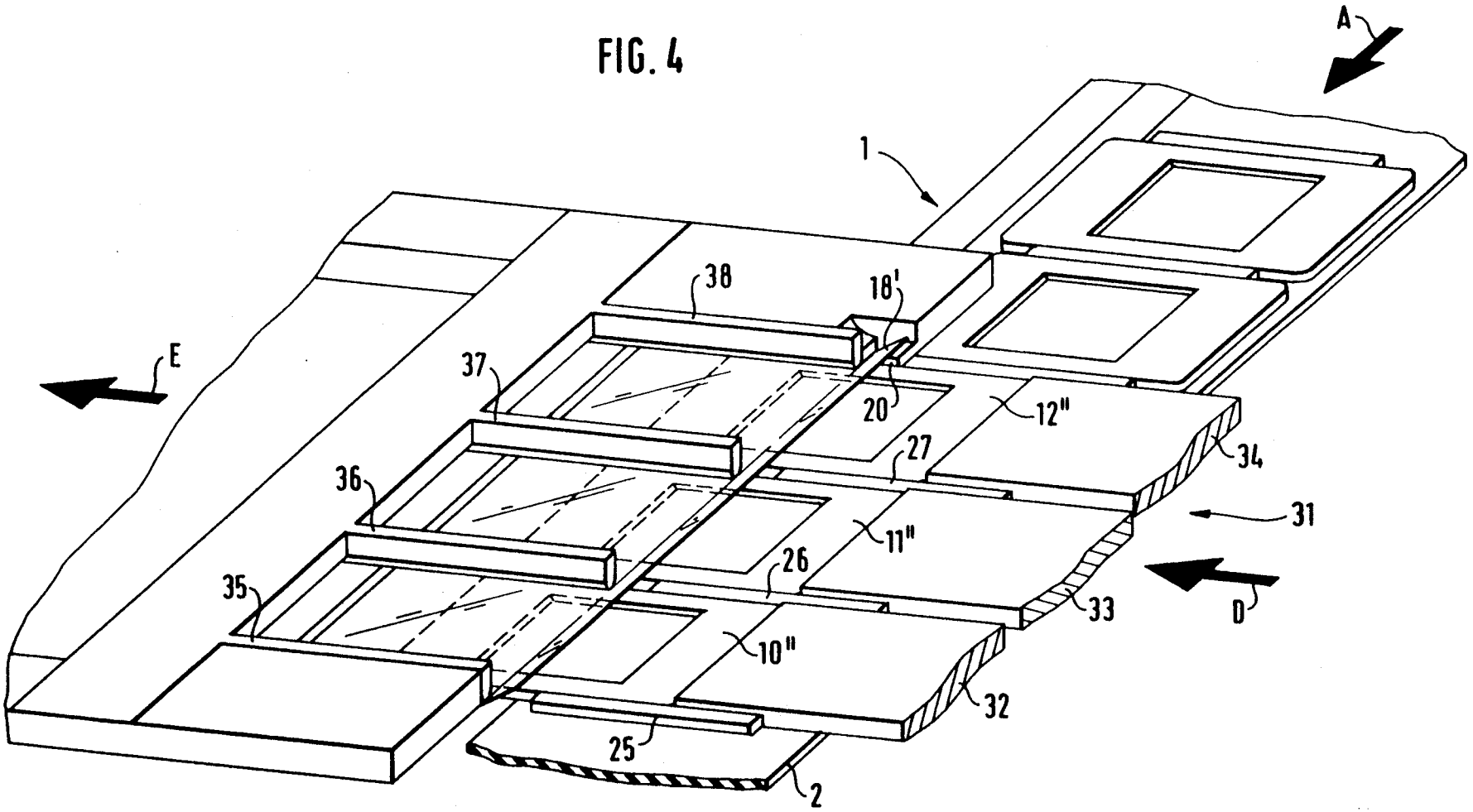
FIG. 4 is a view corresponding to that shown in FIG. 3, during the insertion movement.

Referring firstly generally to the drawings, shown therein is an apparatus for fitting successively supplied flat articles such as photographic slide or transparency frames into respective insertion pockets in a receiving case, comprising a transportation device which is generally identified by reference numeral 1 and which can be for example in the form of an endlessly circulating transportation belt, of which only a part of the upper run is shown at 2. FIGS. 1 and 2 show only a short part of the upper run 2 in order to illustrate a lifting assembly which is described in greater detail hereinafter. FIGS. 3 and 4 also only show that part of the upper run 2 which is required for appropriate description of the method according to the present invention.

As indicated above, the illustrated method and apparatus according to the invention are intended for automatic insertion of slide frames into insertion pockets in a receiving case which for example is a flexible case of plastic foil having pluralities of pockets arranged in juxtaposed relationship and in rows one behind the other. The slides are fed by means of the transportation device 1 to an insertion location in the direction indicated by the arrow A in FIGS. 3 and 4. In the illustrated example, a receiving case 4 which has been fed to the article-insertion location from below same by a suitable means such as a supply roll or the like (not shown) in the direction indicated by the arrow B in FIG. 1 and deflected about a deflection edge indicated at 5 in FIG. 1 through about 90° into a plane 6 which is directed transversely with respect thereto has three pockets 7, 8 and 9 which are arranged in juxtaposed relationship in a respective row. The slide frames to be inserted into the pockets are supplied in a group-wise manner on the transportation device 1, with the number thereof corresponding to the number of insertion pockets 7 through 9 intended to receive slide frames. FIGS. 1 and 2 each show two of the slide frames supplied, as indicated at 10 and 11 therein. The corresponding group of slide frames is identified in FIG. 3 by references 10', 11' and 12', although in FIG. 3 the group of slide frames has been displaced in the direction indicated by the arrow A relative to the view shown in FIGS. 1 and 2, to move them into the position for insertion into the respective pockets.

The pockets 7, 8 and 9 in the receiving case 4 are each accessible from one side thereof, more specifically in the illustrated embodiment from the side which is towards the viewer in the drawings. Adjoining the lateral boundaries or edges 13, 14, 15 and 16 of the pockets in each row of pockets at the side of the opening thereof is a bar portion indicated at 17 in FIG. 1, which can be pivoted upwardly and which extends over the entire length of the pockets 7, 8 and 9 and which has its side edge or corner indicated at 18 in FIGS. 1 and 2 projecting beyond the lateral pocket boundary or edge shown at 16 in FIG. 1. As mentioned above, the receiving case 4 comprises for example a transparent, flexible plastic foil.

As the receiving case 4 is fed to the article-insertion location in the direction indicated by the arrow B in FIG. 1 and is deflected through about 90° at the location indicated at 5 in FIG. 1, the bar portion 17 projects somewhat from the plane of the receiving case 4 which is thus supplied to the article-insertion location from below, as can be clearly seen in FIG. 1. It will also be apparent that, in the position shown in FIG. 1, the bar portion 17 is in the region of the path of movement of the articles or slide frames 10 through 12 when they are moved in the direction indicated by the arrow A towards the article-insertion location. It will be noted in that respect that the plane in which the supplied slide frames are supplied on the top run 2 of the transportation device 1 corresponds to the plane of the pockets or the article-insertion plane, as indicated at 6 in FIG. 1. However, before the group of slide frames 10 through 12 is moved from the position shown in FIG. 1 into the position illustrated in FIG. 3, the edge or corner 18 of the bar portion 17 is lifted and held in a lifted position. In order to achieve that, the illustrated structure includes a stationarily disposed holding projection 20. It will be seen from FIG. 1 that the bar portion 17 is initially disposed with its edge or corner 18 in a position beneath the holding projection 20. The illustrated arrangement further includes a mechanical lifting device 21 which can be raised from the position shown in FIG. 1, in the direction indicated by the arrow C in FIG. 2, into the position indicated at 21' in FIG. 2. The end 22 of the lifting device 21, being the end face which faces upwardly in FIG. 1, engages the bar portion 17 by bearing against the downwardly facing thereof at the edge or corner 18, and moves it into the position indicated at 18' in FIG. 2, in which the corner or edge 18 of the bar portion 17 lies above the projection 20. That can readily be achieved by virtue of the elasticity of the material of the bar portion 17.

After the edge of the bar portion 17 has been moved into the lifted position indicated at 18' in FIGS. 2 through 4, the group of slide frames to be inserted into the respective pockets illustrated is then moved into the position indicated at 10', 11' and 12' in FIG. 3, in the direction indicated by the arrow A. During that movement, the leading edge 23 of the slide frame 10 moves beneath the edge of the bar portion 17, which has been lifted into the position 18'. Subsequently, the edge 24 of the next following slide frame 11 then also moves beneath the bar portion 17, and so forth, so that in that way all the slide frames to be inserted into the respective pockets pass beneath the bar portion 17 although at the beginning it was only the edge 18 of the bar portion 17 that was lifted.

The transportation device 1 has spacer limb portions shown at 25, 26 and 27 for example in FIGS. 3 and 4, the width thereof substantially corresponding to the spacing between the lateral boundaries or edges 13, 14 and 15 of the respective pockets in the row into which the slide frames are to be inserted. That provides that the slide frames to be introduced into the pockets each assume a position precisely in front of the openings indicated at 28, 29 and 30 in FIG. 3 of the respective pockets, while also being positioned beneath the bar portion which is shown in its lifted position at 17' in FIG. 3. When the illustrated structure is in that position, the group of slide frames indicated at 10' through 12' are displaced in the direction indicated by the arrow D in FIG. 3 into the insertion pockets 7 through 9, by means of a diagrammatically illustrated pushing assembly 31 which comprises frame pushing members 32 through 34 for displacing respective ones of the slide frames. The frame pushing members 32 through 34 which are only diagrammatically illustrated are movable jointly. When they move in the direction indicated by the arrow D, the group of slide frames is thus moved from the positions 10' through 12' shown in FIG. 3 and introduced into the insertion pockets, thus taking up the positions indicated at 10", 11" and 12" in FIG. 4. However, the pusher members 32 through 34 then continue to move in the direction indicated by the arrow D in FIG. 3, even when the slide frames have reached the bottom of the respective pocket into which they have just been inserted. That continuing movement of the slide frames, under the drive force imparted thereto by the pusher members 32 through 34, causes the receiving case 4 to be moved away beyond the article-insertion location, in the direction indicated by the arrow E in FIG. 4.

It will be noted that disposed in the region of the article-insertion location, above the receiving case 4 and indicated at references 35 through 38 in both FIGS. 1 and 4 are hold-down devices which are arranged above the lateral boundaries or edges of the pockets defined by the receiving case, and which thus align with the spacer limb portions 25 through 27 of the transportation device 1. The hold-down devices 35 through 38 which are in the form of suitable limb portions serve to prevent the receiving case from moving out of the plane in which it is to be displaced, while at the same time they serve to guide the slide frames during the step of inserting same into the pockets.

The receiving case is then displaced by the movement of the pusher members 32 through 34 in the direction indicated by the arrow E until the bar portion of the next row of pockets, which is supplied from a suitable device such as a supply roll or the like, in the direction indicated by the arrow B in FIG. 1, has again reached the article-insertion position as shown in FIG. 1. The pusher members 32 through 34 are then retracted in the opposite direction to the direction indicated by the arrow D, so that the above-described operating cycle can then follow for the next following group of articles.

In a modification of the above-described procedure, if the number of flat articles such as slide frames supplied to the article-insertion location is less than the number of insertion pockets in a row in the receiving case 4, then the article or articles may be distributed symmetrically to the insertion pockets in the row.

Furthermore, while the edge 18 of the bar portion 17 in the above-described structure is mechanically lifted, it would also be possible for the edge to be lifted and held up by a suction action.

It will be appreciated that the above-described structures and procedures have been set forth solely by way of example and illustration for the principles of the present invention, and that various further modifications and alterations may be made therein without thereby departing from the spirit and scope of the present invention.

What is claimed is:

1. A method of fitting successively supplied flat articles into insertion pockets which are arranged in a receiving case in pluralities in juxtaposed relationship and one behind the other in rows, the insertion pockets being accessible from one side of the receiving case and the upper edges of the insertion pockets each being provided by a bar portion which extends over a plurality of insertion pockets of a row and is adapted to pivot upwardly relative to the lateral boundaries of the insertion pockets, comprising the steps of:

transporting said receiving case to an insertion location for insertion of said articles into said pockets from a direction disposed transversely relative to a plane in which said articles of said group are fed to said insertion location;

feeding said articles to said insertion location in a group-wise manner from a feed device which is disposed transversely with respect to the direction of transportation movement of said receiving case, the number of articles in a group corresponding at maximum to the number of insertion pockets in a row;

positioning said receiving case so that said bar portion is in the region of the path of movement of said articles, with said openings of said insertion pockets being directed rearwardly in the direction of transportation movement of said receiving case and facing toward front edges of said articles with said edges being disposed transversely with respect to the direction of feed of said articles;

bending said receiving case relative to said transporting movement direction in such a way that said insertion pockets are disposed in said plane before a first article of said group has reached an edge of said bar to a lifted position and retaining in said lifted position until subsequent feeding movement of said articles to said insertion location is completed by passing said articles beneath said lifted edge part of said bar portion;

lifting said bar portion by continued feed movement of said articles supplied to said insertion location until said articles which are thus supplied beneath the bar portion are each article aligned with a respective insertion pocket;

pushing said articles into a respective aligned insertion pocket with an insertion movement which is transverse with respect to the article feed direction;

and moving said receiving case after said articles have been pushed into respective insertion pockets by a distance corresponding to a row of said insertion pockets in said insertion direction.

2. A method as set forth in claim 1, wherein:

said transverse direction of transportation of said receiving case is inclined relative to the article feed plane.

3. A method as set forth in claim 1, wherein:

when the number of supplied articles is less than the number of insertion pockets in a row in the receiving case, and wherein at least one article supplied is positioned symmetrically in relation to the number of insertion pockets in said row.

4. A method as set forth in claim 1, wherein:

said edge part of the bar portion is mechanically lifted and held in its lifted position.

5. A method as set forth in claim 1, wherein:

said edge part of the bar portion is lifted and held in its lifted position by a suction action.

6. Apparatus for fitting successively supplied flat articles into insertion pockets which are arranged in a receiving case in pluralities in juxtaposed relationship and one behind the other in rows, the insertion pockets being accessible from one side of the receiving case and edges of the insertion pockets each being provided by a bar portion which extends over a plurality of insertion pockets of a row and is adapted to be pivoted away from the respective insertion pocket relative to the lateral boundaries of the insertion pockets, comprising: means for transportation of the receiving case to an insertion location for insertion of the articles into pockets; a feed means for feeding articles to said insertion location in a group-wise manner, the feed means being disposed transversely with respect to the direction of transportation movement of the receiving case and the feed means being so positioned in relation to said insertion location that when the receiving case is disposed at said insertion location the bar portion thereof is disposed in the region of the path of movement of the articles, said transportation means being adapted to carry the receiving case in such a position that the openings of the insertion pockets are directly rearwardly in the direction of transportation movement of the receiving case and the article feed means being adapted to carry the articles in such a way that front edges thereof face towards said insertion location and thus towards the openings of said insertion pockets, said edges being disposed transversely with respect to the direction of feed of said feed means; means for guiding the receiving case as it moves towards said insertion location from a direction which is disposed transversely relative to the plane in which the articles are fed to said insertion location to a direction such that said insertion pockets thereof are disposed in said plane; means operable before the first article of said group has reached the edge of the bar portion of said receiving case which is toward said article feed side to lift an edge part of said bar portion in such a way that in the subsequent feed movement of the articles to said insertion location they pass beneath said edge part of the bar portion whereby the bar portion is entirely lifted by the articles supplied thereto: means for positioning the articles fed to the insertion pockets at spacings such that they are each aligned with a respectively associated insertion pocket in which they are to be inserted; and means for pushing the articles into the respective insertion pockets with an insertion movement which is transverse with respect to the direction of feed of said article feed means.

7. Apparatus set forth in claim 6, wherein:

said lifting means for lifting said edge part of the bar portion which is towards the article feed side includes a stationarily disposed holding projection for holding said edge part in said lifted position.

8. Apparatus as set forth in claim 6, wherein:

said lifting means comprises pneumatic means.

9. Apparatus as set forth in claim 6, wherein:

said transportation means for feeding a group of articles to said insertion location including spacing limb portions, the width of which at least substantially corresponds to the spacing between the insertion pockets of said receiving case.

10. Apparatus as set forth in claim 6, further including:

hold-down limb portions for the receiving case disposed above the insertion location.

11. Apparatus as set forth in claim 6, wherein:

said lifting means comprises mechanical means.

12. Apparatus as set forth in claim 11, wherein:

said article pushing means are also operable to produce a further transportation movement of said receiving case by a distance corresponding to a row of pockets after said articles have been pushed into said insertion pockets.

* * * * *